US008820298B2

(12) United States Patent
Attwood et al.

(10) Patent No.: US 8,820,298 B2
(45) Date of Patent: Sep. 2, 2014

(54) PASSIVE AND SEMI-ACTIVE DIESEL AND GASOLINE FUEL MODULE

(75) Inventors: William E. Attwood, LaSalle (CA); Norihiro Hayashi, Kakamigahara (JP)

(73) Assignees: DENSO International America, Inc., Southfield, MI (US); Denso Corporation, Kariya-shi, Aichi-ken (JP)

( * ) Notice: Subject to any disclaimer, the term of this patent is extended or adjusted under 35 U.S.C. 154(b) by 1259 days.

(21) Appl. No.: 12/632,175

(22) Filed: Dec. 7, 2009

(65) Prior Publication Data

US 2011/0132328 A1 Jun. 9, 2011

(51) Int. Cl.

| | |
|---|---|
| ***F02M 37/04*** | (2006.01) |
| ***F02M 69/46*** | (2006.01) |
| ***F02M 37/10*** | (2006.01) |
| ***F02M 37/00*** | (2006.01) |

(52) U.S. Cl.

CPC ..... *F02M 37/106* (2013.01); *F02M 37/0082* (2013.01); *F02M 37/0023* (2013.01); *F02M 37/0052* (2013.01); *F02M 37/0094* (2013.01)

USPC ..... 123/456; 123/497

(58) Field of Classification Search

CPC ..... F02M 37/0052; F02M 37/0023; F02M 37/02; F02M 37/025; F02M 37/10; F02M 37/106; F02M 37/0047; F02M 37/0076; F02M 37/0082

USPC ..... 123/446, 447, 452, 456, 457, 459, 495, 123/497, 514

See application file for complete search history.

(56) References Cited

U.S. PATENT DOCUMENTS

| | | | | |
|---|---|---|---|---|
| 6,457,459 | B1 * | 10/2002 | Schelhas et al. | 123/514 |
| 6,705,298 | B2 | 3/2004 | Ramamurthy et al. | |
| 6,805,106 | B2 * | 10/2004 | Kumagai et al. | 123/514 |
| 6,883,500 | B2 | 4/2005 | Powell et al. | |
| 6,886,541 | B2 | 5/2005 | Powell | |

(Continued)

FOREIGN PATENT DOCUMENTS

| | | |
|---|---|---|
| JP | 2001-123904 | 5/2001 |
| JP | 2001-173534 | 6/2001 |
| JP | 2007-120417 | 5/2007 |
| JP | 2008-248803 | 10/2008 |

OTHER PUBLICATIONS

Office Action issued May 20, 2014 in corresponding JP Application No. 2010-225021 (with English translation).

*Primary Examiner* — Hieu T Vo
*Assistant Examiner* — Arnold Castro
(74) *Attorney, Agent, or Firm* — Harness, Dickey & Pierce, P.L.C.

(57) ABSTRACT

A vehicle fuel system may employ a fuel pump module with a reservoir within a fuel tank. The system may also employ a fuel injection common rail, a fuel supply line leading from the fuel pump module reservoir to the fuel injection common rail, and a fuel return line leading from the fuel injection common rail through a fuel pump module flange. Additionally, the system may employ a first return fuel check valve to release fuel only into a reservoir jet pump and/or a transfer jet pump, while a second return fuel check valve may release fuel only directly into the fuel pump module reservoir. An electric fuel pump within the reservoir may have a fuel pump check valve and supply fuel only to the reservoir jet pump and/or the transfer jet pump, and not to an engine, when activated by a pressure sensor in the fuel return line.

16 Claims, 4 Drawing Sheets

(56) References Cited

U.S. PATENT DOCUMENTS

| | | | | |
|---|---|---|---|---|
| 6,904,928 | B2 | 6/2005 | Powell et al. | |
| 6,928,989 | B2 | 8/2005 | Powell | |
| 7,121,266 | B2 | 10/2006 | Powell | |
| 7,168,416 | B2 | 1/2007 | Powell et al. | |
| 7,278,404 | B2 * | 10/2007 | Wolters et al. | 123/514 |
| 7,284,540 | B2 | 10/2007 | Attwood et al. | |
| 7,383,822 | B2 | 6/2008 | Ramamurthy et al. | |
| 7,431,020 | B2 | 10/2008 | Ramamurthy | |
| 7,506,636 | B2 | 3/2009 | Lubinski et al. | |
| 2003/0062031 | A1 * | 4/2003 | Tanimura | 123/510 |
| 2008/0178849 | A1 * | 7/2008 | Crary | 123/506 |

* cited by examiner

PASSIVE AND SEMI-ACTIVE DIESEL AND GASOLINE FUEL MODULE

FIELD

The present disclosure relates to a fuel pump module and a method of control of a fuel pump module.

BACKGROUND

The statements in this section merely provide background information related to the present disclosure and may not constitute prior art. Modern vehicles may employ a fuel supply system and more specifically, a fuel pump module such as that depicted in FIG. 1. Such a fuel pump module may employ a return fuel line 2 that returns unused fuel from an internal combustion engine to a fuel reservoir 4 at the same time that fuel is delivered from a fuel tank to the engine. As part of an overall fuel supply system, a vacuum is created in a fuel supply line 6 by a fuel injection pump, which may draw fuel from reservoir 4 to deliver such fuel to the engine. Fuel that is unused by the engine may be returned to fuel reservoir 4 and pass through a transfer jet pump 8 and a reservoir jet pump 10, both residing within fuel reservoir 4. As depicted, no fuel pump is present within reservoir 4, which may reside within a vehicle fuel tank.

FIG. 2 depicts another arrangement of components within fuel reservoir 4 in accordance with the prior art. More specifically, fuel reservoir 4 may employ fuel supply line 6 to supply fuel to an engine while return fuel line 2 may deliver unused fuel from the engine directly to fuel reservoir 4, without passing through any jet pumps. However, reservoir 4 of FIG. 2 also contains and employs an electric fuel pump 12 to pump liquid fuel into transfer jet pump 8 and reservoir jet pump 10. When electric fuel pump 12 is employed within reservoir 4, as depicted in FIG. 2, return fuel line 2 has no connection to a transfer jet pump 8 or reservoir jet pump 10, but instead an electric fuel pump 12 is directly connected to transfer jet pump 8 and reservoir jet pump 10 to permit just pumps 8, 10 to properly function. However, the structures of FIGS. 1 and 2, and their functionality, are not without their share of limitations. For instance, FIG. 1 depicts an arrangement in which fuel flow volume and pressure within return fuel line 2 must be sufficient enough at all times to invoke proper function of transfer jet pump 8 and reservoir jet pump 10 and may only be used in applications in which an engine fuel injection pump can adequately deliver an excess fuel flow of sufficient flow volume and pressure to operate transfer jet pump 8 and reservoir jet pump 10. During periods of excessive engine fuel demand, such a flow and pressure may be insufficient and starve transfer jet pump 8 and reservoir jet pump 10 of fuel, thus provoking a decrease in levels of fuel in reservoir 4. FIG. 2 depicts an arrangement in which electric fuel pump 12 is necessary to provide sufficient flow volume and flow pressure to transfer jet pump 8 and reservoir jet pump 10. Electric fuel pump 12 must operate at all times that the engine operates, thus decreasing pump longevity and increasing electrical consumption from a vehicle alternator or battery.

While arrangement of components within fuel reservoir 4, as depicted in FIGS. 1 and 2, has been satisfactory for their different purposes, a need exists for a single fuel delivery module and fuel delivery system that is capable of being used in all fuel delivery systems, regardless of fuel consumption by the engine, but that also conserves electrical energy consumed by a module fuel pump.

SUMMARY

This section provides a general summary of the disclosure, and is not a comprehensive disclosure of its full scope or all of its features. A vehicle fuel system may employ a fuel pump module within a fuel tank, the fuel pump module employing a fuel pump module reservoir. Moreover, the fuel system may employ a fuel injection common rail, a fuel supply line leading from the fuel pump module reservoir to the fuel injection common rail, and a fuel return line leading from the fuel injection common rail through a fuel pump module flange. Moreover, as part of the fuel system, a first return fuel check valve may release fuel into a reservoir jet pump and a transfer jet pump, while a second return fuel check valve may release fuel directly into the fuel pump module reservoir. An electric fuel pump may be located within the fuel pump module reservoir and a fuel pump check valve may be attached to the electric fuel pump, the electric fuel pump and the fuel pump check valve may supply fuel only to the reservoir jet pump and the transfer jet pump, and not to an engine.

A method of operating a vehicle fuel system may entail supplying a quantity of fuel from an engine-driven fuel injection pump to a common rail of an engine, supplying a quantity of unused return fuel through a fuel return line from the common rail through a fuel pump module flange in a single fuel path, and dividing the single fuel path, after passing through the fuel pump module flange, into dual paths. A first divided fuel path of the dual paths passes through a first return fuel check valve and flows through a first jet pump, such as a reservoir jet pump.

A method of operating a vehicle fuel system may further entail sensing a fuel pressure in the fuel return line with a pressure sensor or a pressure transducer, and turning off an electric fuel pump when the fuel pressure is sensed by the pressure sensor or transducer to be above a threshold value. Additionally, the method may entail turning on an electric fuel pump when the fuel pressure is sensed to be below a threshold value. When the electric fuel pump is turned on, the method may entail pumping fuel from the electric fuel pump and into a first jet pump and a second jet pump. When the electric fuel pump is operating, the method may entail opening a second return fuel check valve to relieve pressure and fuel within the return fuel line. Such pressure may be relieved by the second return fuel check valve when the fuel pressure created by the electric fuel pump prevents the first return fuel check valve from opening. The second return fuel check valve opens directly into a fuel pump module reservoir of the fuel pump module. The first divided fuel path passes through the first return fuel check valve and flows through a second jet pump, which may be a transfer jet pump to transfer fuel from another fuel tank or another side of a saddle fuel tank.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
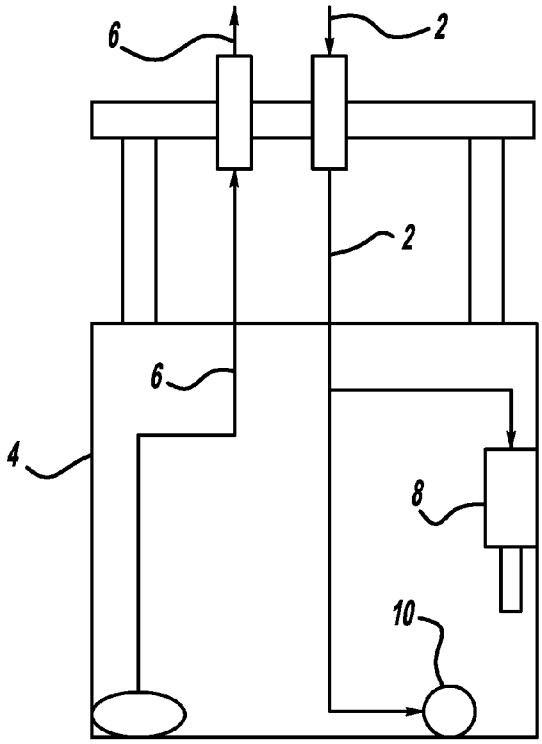
FIG - 1 Prior Art
FIG. 1 is a schematic view of a prior art fuel pump module.
Figure 2:
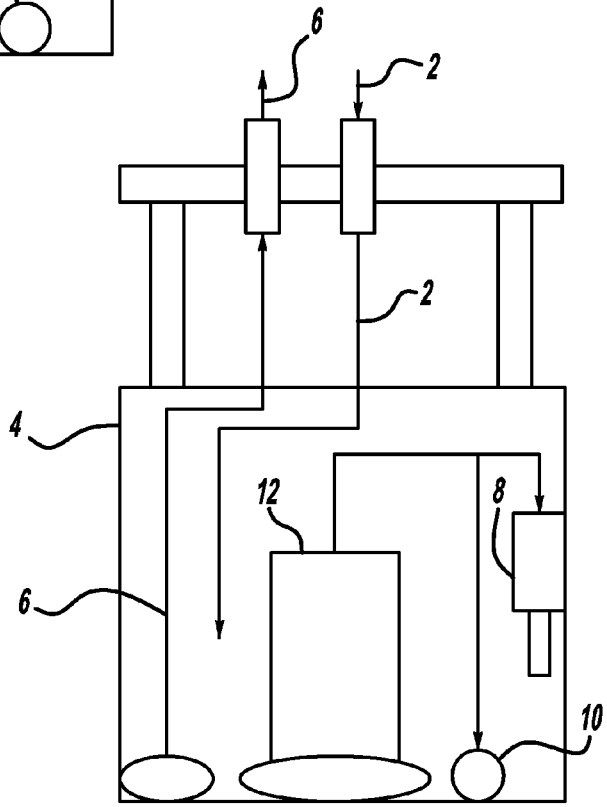
FIG - 2 Prior Art
FIG. 2 is a schematic view of a prior art fuel pump module.

The following description is merely exemplary in nature and is not intended to limit the present disclosure, application, or uses. It should be understood that throughout the drawings, corresponding reference numerals indicate like or corresponding parts and features. With reference to FIGS. 3-7, a single fuel delivery module that is capable of being used in a wide array of engine applications involving varying fuel injection pump capacities, such as in vehicles utilizing diesel fuel delivery systems, will be described.

Figure 3:
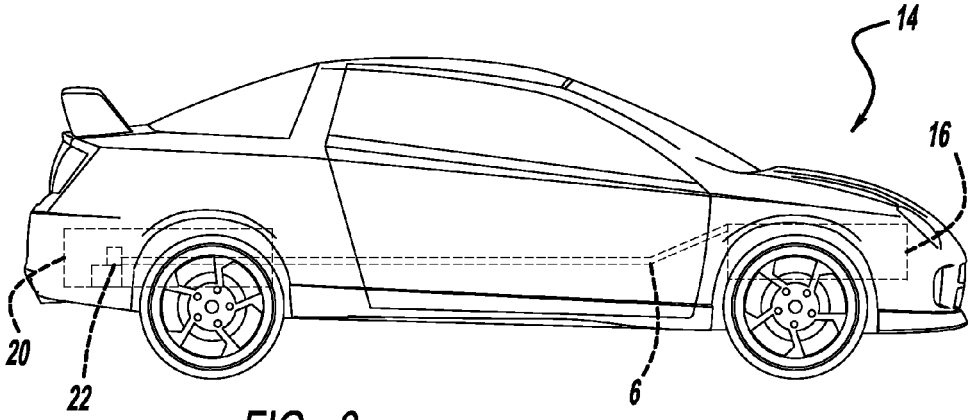
FIG. 3 is a side view of a vehicle depicting, in phantom, portions of a fuel system.
Figure 4:
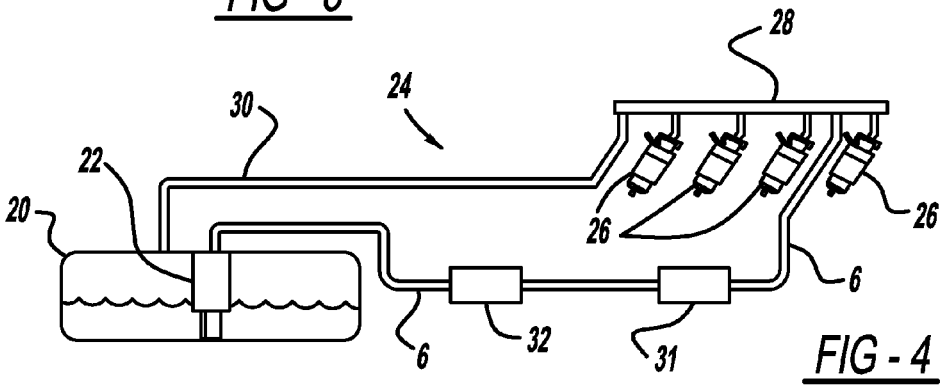
FIG. 4 is a schematic of a vehicle fuel supply system depicting fuel injectors, a fuel injection pump and a fuel pump module within a fuel tank.

FIG. 3 depicts a vehicle 14, such as an automobile, having an engine 16, a fuel supply line 6, a fuel tank 20, and a fuel pump module 22. Fuel pump module 22 resides within fuel tank 20 and may be submerged in or surrounded by varying volumes of liquid fuel when fuel tank 20 possesses liquid fuel. For purposes of explanation of the present disclosure, the liquid fuel may be considered diesel fuel since the present teachings will be explained in the context of a fuel supply system 24 that employs a fuel injection pump 31, which are common on diesel engines. However, it is to be understood that the present teachings may be adaptable to a vehicle employing gasoline, or other liquid fuel. Fuel pump module 22 may be involved in supplying liquid fuel to engine 16 through fuel supply line 6. FIG. 4 depicts fuel supply system 24 in which fuel injectors 26 installed in engine 16 receive fuel from a fuel injector common rail 28, for example, and return unused fuel to fuel tank 20. To reach a fuel pressure that is high enough to support combustion, fuel may be pressurized by a fuel injection pump 31 before fuel reaches common rail 28. To ensure that fuel is clean enough to pass through fuel injection pump 31 and then fuel injectors 26, fuel may pass through a fuel filter 32 resident in fuel supply line 6.

Figure 5:
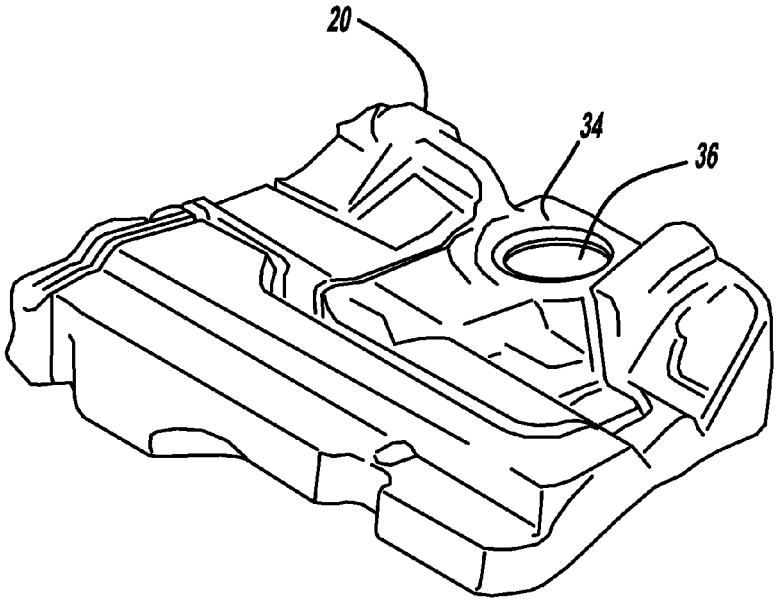
FIG. 5 is a perspective view of a vehicle fuel tank depicting a mounting location of a fuel pump module.
Figure 6:
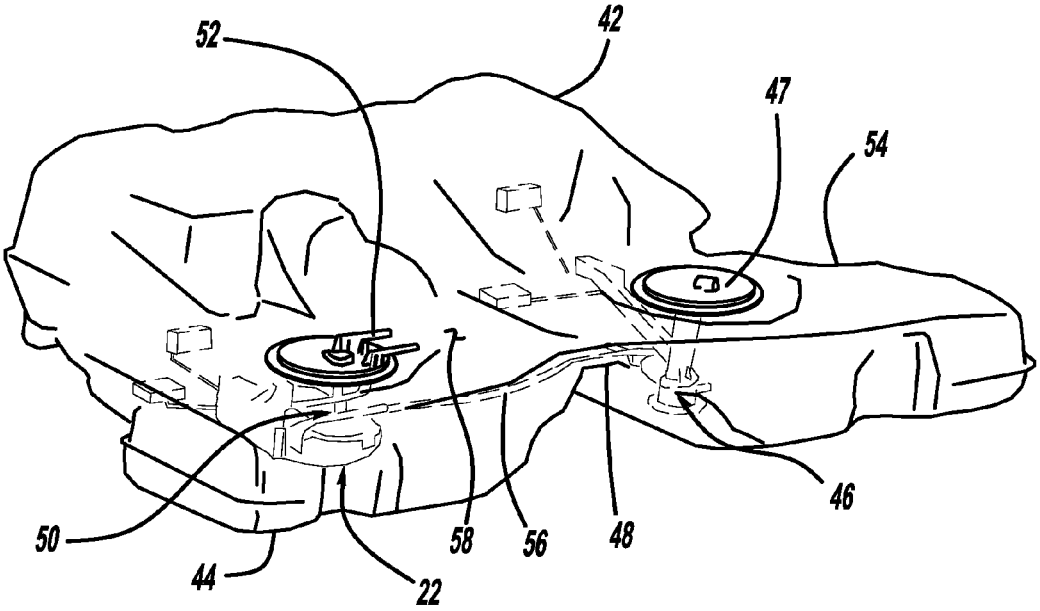
FIG. 6 is a perspective view of a saddle fuel tank employing a fuel pump module and a fuel transfer system.
Figure 7:
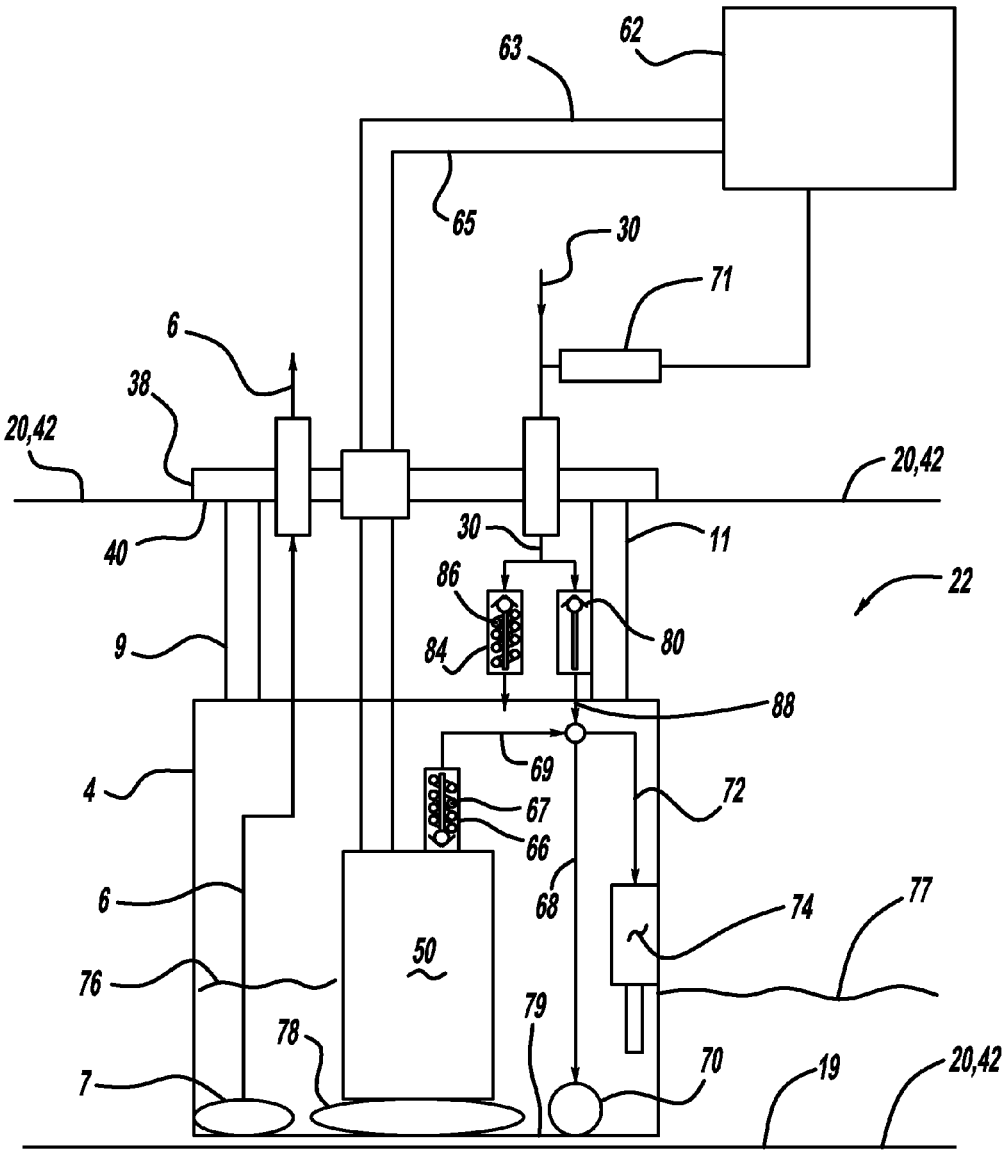
FIG. 7 is a schematic of a vehicle fuel supply system in accordance with the present teachings.

FIG. 5 depicts a fuel tank 20, which is a non-saddle style of fuel tank, with a mounting surface 34 surrounding a hole 36, which is resident in a top surface of fuel tank 20. Mounting surface 34 is for mating or abutting with fuel pump module flange 38, and more specifically, bottom surface 40 of flange 38 (FIG. 7). FIG. 6 depicts a saddle fuel tank 42 with which fuel pump module 22 (FIG. 7) of the present disclosure may be used. Moreover, saddle fuel tank 42 includes a fuel tank main side 44, a fuel tank sub side 54 and a bridge section 48. Fuel tank main side 44 houses a fuel pump 50 which may be installed within fuel pump module 22. Fuel pump 50 pumps fuel from fuel tank main side 44 to engine 16 through an outlet 52 which is connected to fuel supply line 6. Fuel tank main side 44 communicates with fuel tank sub side 54 through bridge section 48 and a transfer line 56, which extends from fuel tank sub side 54 to fuel tank main side 44 though bridge section 48. Fuel may be transferred from transfer module 47 on sub side 54 to module 22 and reservoir 4 on main side 44, as is explained in commonly owned U.S. Pat. Nos. 7,284,540 and 7,506,636, which are both herein incorporated by reference. Continuing, fuel pump module 22 may mount through top surface 58 of saddle fuel tank 42 in a fashion similar to fuel tank 20 of FIG. 5.

With reference now including FIG. 7, further details of the present disclosure will be explained. Fuel pump 50 within fuel reservoir 4 of fuel pump module 22 may communicate with a fuel pump controller 62 through communication lines 63, 65. Moreover, fuel pump controller 62 may communicate with a monitoring device 71 that measures one or more parameters of fuel in fuel return line 30. For instance, monitoring device 71 may be a pressure transducer, which may continuously monitor and measure fuel pressure within fuel return line 30, such as in fuel line 30 immediately exterior to fuel pump module 22. In another example, monitoring device 71 may be a flow meter that monitors a volume flow rate of fuel, such as a volume of fuel per unit of elapsed time. Still yet, monitoring device 71 may include a pressure transducer that converts a measured or monitored value, such as pressure or flow rate, and convert such measurement to an electrical impulse for controller 62. Fuel pump 50 may be controlled and operate independently from fuel injection pump 31, which supplies fuel directly to engine 16 upon drawing fuel from suction port 7 through fuel supply line 6, which passes through fuel pump module flange 38, and onto engine 16. Fuel pump 50 does not directly supply fuel to engine 16, but operates to supply fuel to maintain operation of a reservoir jet pump and a transfer jet pump within reservoir 4. Operationally, liquid fuel may be drawn from within reservoir 4, and more specifically, from at or near a bottom interior surface 79 of reservoir 4 through suction filter 78, which may be situated against bottom interior surface 79 of reservoir 4. Fuel reservoir 4 may be secured against or adjacent a bottom interior surface 19 of fuel tank 20 by struts 9, 11. Liquid fuel pumped from fuel pump 50 as a single stream passes from fuel pump 50 and through a fuel pump check valve 66 and then a fuel pump check valve line 69 before being divided into two fuel streams. Fuel pump check valve 66 may be located on top of fuel pump 50 such that all fuel pumped from fuel pump 50 passes through fuel pump check valve 66. Fuel pump check valve 66 permits liquid fuel to pass from fuel pump 50 but prevents liquid fuel from passing into fuel pump 50 when fuel pump 50 is not operating. A spring 67 in check valve may provide a force to close fuel pump check valve 66 when fuel pump 50 is not pumping fuel.

A first stream of fuel may pass through a reservoir jet pump line 68 and into a reservoir jet pump 70, while at the same time a second stream of fuel may pass through a transfer jet pump line 72 and into a transfer jet pump 74. Reservoir jet pump 70 may operate in accordance with fluid flow principles to produce a venturi effect and cause liquid fuel to be drawn through an orifice or hole in the bottom surface of reservoir 4 to maintain fuel 76 in reservoir 4 at a fuel level that is satisfactory for fuel pump 50 to draw fuel into suction filter 78, which may be against an interior bottom surface of reservoir 4. Similarly, when a saddle fuel tank 42 is utilized in a vehicle, transfer jet pump 74 may be employed and operate to produce the same venturi effect to cause fuel to be drawn from fuel tank sub side 54 to fuel tank main side 44 by way of transfer line 56. Transfer jet pump 74 may also be used in a dual fuel tank arrangement, as opposed to a saddle fuel tank 42, which is depicted in FIG. 6.

Continuing with FIG. 7, a first return fuel check valve 80 may be employed to permit liquid fuel to pass into reservoir jet pump line 68 to operate reservoir jet pump 74, and to permit liquid fuel to pass into transfer jet pump line 72 to operate transfer jet pump 74. Thus, first return fuel check valve 80 may be a one-way check valve that only permits fuel from fuel return line 30 to flow into reservoir 4. When fuel pump 50 is not operating, liquid fuel that is not consumed in the engine combustion process will be returned to reservoir 4 through fuel return line 30 and return fuel check valve 80. When fuel pump 50 is not operating, second return fuel check valve 84 remains closed. Thus, first return fuel check valve 80 is utilized when fuel supply to engine 16 is in excess, such as when engine 16 is not operating at wide open throttle. When electric fuel pump 50 is operating, fuel may be unable to pass through first return fuel check valve 80, as will be explained.

FIG. 7 also depicts a second return fuel check valve 84, which may be a one-way check valve. That is, second return fuel check valve 84 may permit fuel to directly flow into reservoir 4 without being diverted to reservoir jet pump 70 or transfer jet pump 74. Second return fuel check valve 84 may be biased to a closed position, as depicted in FIG. 7, when no fuel is flowing in fuel return line 30, or when pressure in fuel return line 30 is insufficient to bias spring 86. With continued reference to FIG. 7, when fuel injection pump 31 operates to draw liquid fuel 76 from reservoir 4, a quantity of the liquid fuel may be returned to fuel tank 20 via fuel return line 30. Such return fuel may pass through flange 38 and first return check valve 80, and proceed into fuel line 88, which exits first return fuel check valve 80. Upon passing from fuel line 88, the fuel is divided between reservoir jet pump line 68 to operate reservoir jet pump 70, and transfer jet pump line 72 and transfer jet pump 74, if a vehicle is so equipped with a transfer jet pump 74. When either or both of reservoir jet pump 70 and transfer jet pump 74 operate from fuel passing from fuel return line 30 alone, and without the aid of electric fuel pump 50, such operation is termed a "passive" fuel system or to be in a "passive mode." Thus, in passive mode, electric fuel pump 50 does not operate and only first return check valve 80 opens to permit fuel to pass into jet pumps 70, 74. While operating in passive mode, excess fuel is being supplied to engine 16, such as when engine is not cranking during starting or when engine is not operating at wide open throttle, which may lessen fuel supplies to reservoir jet pump 70 and transfer jet pump 74.

An alternative to "passive" fuel system operation, as described above, is "semi-active" operation of the fuel system. More specifically, during semi-active operation, electric fuel pump 50 is used to operate both of reservoir jet pump 70 and transfer jet pump 74, if a vehicle is so equipped with a transfer jet pump 74. Thus, electric fuel pump 50 may operate at all times that engine 16 is operating to ensure that reservoir jet pump 70 and transfer jet pump 74 are operating at all times, even during periods of engine cold starting and periods of high fuel demand from engine 16, such as during engine wide open throttle. Thus, during "semi-active" operation, with fuel flowing from electric fuel pump 50 and flowing through fuel return line 30, fuel may pass through first return fuel check valve 80 when fuel pressures on opposing sides of first return fuel check valve 80 permit opening of first return fuel check valve 80. In the event that fuel pressure in fuel return line 30 not sufficient to open first return fuel check valve 80, due to pressure in fuel pump check valve line 69, second return fuel check valve 84 will open to relieve pressure and permit excess fuel being returned from engine 16, to flow directly into reservoir 4, thus permitting return flow of fuel in fuel return line 30 while electric fuel pump 50 continues continuous operation. Second return fuel check valve 84 may be set to open at a prescribed force due to fuel pressure.

Another method of operation of fuel supply system 24 involves using fuel pump controller 62 and monitoring device 71, such as a pressure transducer, to invoke intermittent or continuous use of electric fuel pump 50. More specifically, when engine 16 is operating, fuel injection pump 31, which may be resident within the engine compartment and driven by engine 16, creates a vacuum force sufficient to draw fuel from fuel tank 20 to supply engine 16. The draw due to vacuum force may be proportional to engine speed and draw more than enough fuel for utilization by engine 16, regardless of engine speed. Excess fuel that is not required for engine operation is returned to fuel reservoir 4 within fuel tank 20 by passing through first return fuel check valve 80 only, and not any other valves that permit access to tank 20 or reservoir 4. With fuel passing in this fashion to reservoir 4, jet pumps 70, 74 receive enough return fuel to each create a vacuum to draw fuel from their designated locations, as described above and known in the art. When return fuel is flowing through fuel return line 30 in such a volume, monitoring device 71 senses that return fuel is available to fuel pump module 22 for operation of jet pumps 70, 74 and a signal is sent from monitoring device 71 to fuel pump controller 62 to ensure that electric fuel pump 50 is maintained in an "off" or non-operational condition because jet pumps 70, 74 are receiving enough fuel to operate from return fuel from engine 16 via fuel return line 30. With sufficient return fuel, jet pump 70 is able to ensure that a level of fuel 76, such as that depicted in FIG. 7, or higher, is maintained in fuel reservoir 4 by drawing from volume of fuel 77 in fuel tank 20.

When demand by engine 16 is such that one hundred percent or nearly one hundred percent of the fuel supplied by fuel injection pump 31 is consumed by engine 16, relatively little or no return fuel may be present in fuel return line 30. Fuel may not be present in return fuel line 30 during periods of cold starting, such as when engine 16 is cranking and demanding large volumes of fuel, or when engine 16 is operating under a condition of wide open throttle. Other operating conditions are possible that may demand one hundred percent or nearly one hundred percent of the fuel pumped by fuel injection pump 31. When return fuel line 30 does not contain any fuel, or enough fuel to properly operate jet pump 70 or jet pumps 70, 74, monitoring device 71 senses such low fuel pressure and/or low volume flow rate condition and sends a signal to fuel pump controller 62, which in turn sends a signal to electric fuel pump 50 to permit electrical power to flow to electric fuel pump 50, thereby permitting jet pumps 70, 74 to be operated from fuel resident within reservoir 4. When electric fuel pump 50 operates, fuel is permitted to pass through fuel pump check valve 66 permitting jet pumps 70, 74 to operate, and also causing first return fuel check valve 80 to close. Thus, when electric fuel pump 50 is operating, fuel may be maintained within reservoir 4. Fuel may be maintained at nearly any level within reservoir 4.

Second return fuel check valve 84 is in place and permitted to open when electric fuel pump 50 is operating. More specifically, second return fuel check valve 84 will open when pressure within return fuel line 30 reaches a predetermined pressure. When electric fuel pump 50 is operating, first return fuel check valve 80 closes because pressure in line 88 generated by electric fuel pump 50 forces first return fuel check valve 80 to a closed position. Thus, in the event that pressure within return fuel line 30 rises above the set point of second return fuel check valve 84, second return fuel check valve 84 will open and discharge fuel directly into reservoir 4. Pressure within return fuel line 30 may increase due to heat within the engine compartment, such as from the heat due to combustion and/or heat from a relatively hot surface upon which a vehicle traverses or is parked, such as black asphalt. The opening set point of second return fuel check valve 84 may be determined based upon the fuel system within which second return fuel check valve 84 is placed. That is, spring constant of spring 86 may be changed such that it will compress and open second return fuel check valve 84 at specific fuel pressures within fuel return line 30. Engine fuel volume consumption and fuel injection pump 31 capability may also play a role in creating specific fuel pressures in return fuel line 30 and govern opening of second return fuel check valve 84.

There are several advantages to the teachings of the present disclosure. First, by intermittently turning electric fuel pump 50 on and off depending upon a pressure within return fuel line 30, as sensed by a pressure or volume flow rate monitoring device 71, electrical draw on a vehicle's electrical system may be reduced. Second, the useful life of electric fuel pump 50 may be extended because electric fuel pump 50 is only being turned on when fuel pressure within return fuel line 30 reaches a pressure less than that required to operate jet pumps 70, 74. Thus, electric fuel pump 50 may not be in operation at all times that engine 16 is operating. Third, yet another advantage of the present teachings is that fuel valves 66, 80, 84 are under fuel pump module flange 38, that is, within fuel pump module 22 and within fuel tank 20. Thus, valves 66, 80, 84 may be pre-assembled as part of fuel pump module 22 and may be installed as a single unit into fuel tank 20.

In another example of the use of the present teachings, monitoring device 71 may be omitted while maintaining proper operation. More specifically, drawing fuel from a fuel pick up point, such as in a vehicle fuel tank 20, may be estimated based upon the drawing or suction capability of a direct injection pump at a certain RPM of engine 16. Fuel consumption by engine 16 may be estimated upon engine load, throttle position, engine RPM, injector pulses and other parameters. Therefore, estimating a volume of return fuel, which is the volume of fuel being returned to fuel tank 20 in return fuel line 30, may be accomplished by subtracting fuel consumption by engine 16 from the suction fuel flow from the pick up point, such as that point in fuel tank 20. Fuel pump controller 62 could then use such information, that is, the pick up volume, engine consumption volume and return fuel volume in return line 30 to arrive at fuel pump operation parameters. For instance, if the return fuel volume (i.e. volume flow rate) is greater than a predetermined threshold, then fuel pump 50 may be turned off or remain off; however, if the volume flow rate being returned to fuel tank 20 is less than the predetermined threshold, then the pump may be turned on or pump a greater volume of fuel. An advantage of operating a fuel system without monitoring device 71 is the reduction in part count and a corresponding reduction in fuel system costs.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A vehicle fuel system comprising:
- a fuel pump module and fuel pump module reservoir;
- a fuel injection common rail;
- a fuel supply line leading from the fuel pump module reservoir to the fuel injection common rail;
- a fuel return line leading from the fuel injection common rail through a flange of the fuel pump module;
- a first return fuel check valve that releases fuel into a jet pump;
- a second return fuel check valve that releases fuel directly into the fuel pump module reservoir;
- an electric fuel pump located within the fuel pump module reservoir; and
- a fuel pump module check valve attached to the electric fuel pump, the electric fuel pump and the fuel pump module check valve supplying fuel only to the jet pump.

2. The vehicle fuel system according to claim 1, further comprising:
- a fuel pump controller that controls the fuel pump; and
- a pressure transducer installed in the fuel return line that senses a fuel pressure within the fuel return line and communicates with the fuel pump controller.

3. The vehicle fuel system according to claim 2, wherein the first return fuel check valve the second return fuel check valve receive fuel directly from the fuel return line.

4. The vehicle fuel system according to claim 1, wherein the jet pump is a reservoir jet pump located within the reservoir.

5. The vehicle fuel system according to claim 1, wherein the jet pump is a transfer jet pump that transfers fuel from a location outside of the reservoir to within the reservoir.

6. A vehicle fuel system comprising:
- a fuel injection common rail as part of an engine;
- a fuel pump module reservoir of a fuel pump module from which fuel is supplied to the fuel injection common rail;
- a fuel return line leading from the fuel injection common rail through a fuel pump module flange;
- a flow meter installed in the fuel return line proximate the fuel pump module flange, the flow meter for measuring a flow rate within the fuel return line;
- a first return fuel check valve that releases fuel into a jet pump;
- a second return fuel check valve that releases fuel directly into the fuel pump module reservoir;
- a fuel pump controller that controls the fuel pump and communicates with the fuel pump; and
- an electric fuel pump located within the fuel pump module reservoir, wherein the electric fuel pump is turned on and off by the fuel pump controller.

7. The vehicle fuel system according to claim 6, further comprising:
- a fuel pump module check valve attached to the electric fuel pump, the electric fuel pump and the fuel pump module check valve supplying fuel only to the jet pump.

8. The vehicle fuel system according to claim 7, wherein the first return fuel check valve the second return fuel check valve receive fuel directly from the fuel return line.

9. The vehicle fuel system according to claim 6, wherein the jet pump is one of a reservoir jet pump and a transfer jet pump.

10. The vehicle fuel system according to claim 6, wherein the jet pump is a reservoir jet pump, the fuel system further comprising;

a transfer jet pump, wherein the first return fuel check valve also releases fuel into the transfer jet pump.

11. A method of operating a vehicle fuel system comprising:

supplying a quantity of fuel from a fuel injection pump to a common rail of an engine;

supplying a quantity of return fuel through a fuel return line from the common rail through a fuel pump module flange in a single fuel path;

dividing the single fuel path aft of the fuel pump module flange into a dual path, wherein a first divided fuel path passes through a first return fuel check valve and flows through a first jet pump;

sensing a fuel pressure in the fuel return line with a pressure transducer; and turning off an electric fuel pump when the fuel pressure is sensed to be above a threshold value.

12. A method of operating a vehicle fuel system comprising:

supplying a quantity of fuel from a fuel injection pump to a common rail of an engine;

supplying a quantity of return fuel through a fuel return line from the common rail through a fuel pump module flange in a single fuel path;

dividing the single fuel path aft of the fuel pump module flange into a dual path, wherein a first divided fuel path passes through a first return fuel check valve and flows through a first jet pump;

sensing a fuel pressure in the fuel return line with a pressure transducer; and turning on an electric fuel pump when the fuel pressure is sensed to be below a threshold value.

13. The method of operating a vehicle fuel system according to claim 12, further comprising:

pumping fuel from the electric fuel pump and into a first jet pump and a second jet pump.

14. The method of operating a vehicle fuel system according to claim 13, further comprising:

opening a second return fuel check valve to relieve pressure and fuel within the return fuel line.

15. The method of operating a vehicle fuel system according to claim 14, wherein the second return fuel check valve opens directly into a fuel pump module reservoir of a fuel pump module.

16. The method of operating a vehicle fuel system according to claim 15, wherein the first divided fuel path passes through the first return fuel check valve and flows through a second jet pump.

* * * * *